US012796796B2

(12) United States Patent
Liu

(10) Patent No.: US 12,796,796 B2
(45) Date of Patent: Nov. 17, 2026

(54) PORTABLE NAIL LAMP

(71) Applicant: KISS NAIL PRODUCTS, INC., Port Washington, NY (US)

(72) Inventor: Huachen Liu, Port Washington, NY (US)

(73) Assignee: KISS NAIL PRODUCTS, INC., Port Washington, NY (US)

( * ) Notice: Subject to any disclaimer, the term of this patent is extended or adjusted under 35 U.S.C. 154(b) by 0 days.

(21) Appl. No.: 19/318,342

(22) Filed: Sep. 3, 2025

(65) Prior Publication Data

US 2026/0069018 A1 Mar. 12, 2026

Related U.S. Application Data

(60) Provisional application No. 63/693,171, filed on Sep. 10, 2024.

(51) Int. Cl.
*A45D 29/00* (2006.01)

(52) U.S. Cl.
CPC ..... *A45D 29/00* (2013.01); *A45D 2200/205* (2013.01)

(58) Field of Classification Search
CPC ..... A45D 29/00; A45D 29/18; A45D 29/20; B05D 3/067
USPC ..... 250/455.11, 492.1, 504 R
See application file for complete search history.

(56) References Cited

U.S. PATENT DOCUMENTS

| | | | | |
|---|---|---|---|---|
| 3,287,824 | A * | 11/1966 | Selditz | A45D 29/18 34/202 |
| 5,249,367 | A * | 10/1993 | Nafziger | B05D 7/532 34/275 |
| 2014/0173927 | A1* | 6/2014 | Kim | A45D 29/20 34/275 |
| 2019/0167827 | A1* | 6/2019 | Gaska | A61L 2/10 |
| 2019/0331420 | A1 | 10/2019 | Valia et al. | |
| 2021/0161271 | A1 | 6/2021 | Cheng | |

FOREIGN PATENT DOCUMENTS

| | | |
|---|---|---|
| CN | 202842707 | 4/2013 |
| JP | 3180139 | 12/2012 |
| KR | 10-1318798 | 10/2013 |
| KR | 10-1330081 | 11/2013 |
| KR | 10-1598058 | 2/2016 |
| KR | 10-2023-0001441 | 1/2023 |

* cited by examiner

*Primary Examiner* — Thomas M Sember
(74) *Attorney, Agent, or Firm* — PnK IP LLC

(57) ABSTRACT

A portable nail lamp includes: a lamp unit configured as a hollow body and including a plurality of lamps arranged on a lower surface thereof to emit light downward for curing a nail coating; a support unit formed as a plate member and disposed to face the lamp unit; and at least one support arm connecting the lamp unit and the support unit, the support arm having opposite ends hinge-coupled to the lamp unit and the support unit, respectively, and configured to permit adjustment of a height and an angle of the lamp unit relative to the support unit.

13 Claims, 5 Drawing Sheets

PORTABLE NAIL LAMP

CROSS REFERENCE TO RELATED APPLICATION

This application claims priority from and the benefit of U.S. Provisional Patent Application No. 63/693,171, filed on Sep. 10, 2024, which is hereby incorporated by reference for all purposes as if fully set forth herein.

BACKGROUND

Field

Embodiments of the invention relate generally relates to a nail lamp, and more particularly, to a portable nail lamp in which a user can freely adjust the height and angle of a lamp unit.

Discussion of the Background

Conventional nail coating compositions can generally be classified into two categories: nail polishes (e.g., lacquers, varnishes, enamels) and artificial nails (e.g., gels or acrylics).

Nail polish typically contains various solid components dissolved or dispersed in a non-reactive solvent. After application, the solvent evaporates and the solid components form a transparent, translucent, or colored film on the nail surface. However, such nail polishes are generally susceptible to scratching and can be easily removed by a solvent. In most cases, removal can be achieved within about one minute, and if not intentionally removed, the polish may peel or chip from the nail surface within approximately one to five days.

In contrast, artificial nails are produced by combining chemically reactive monomers and/or oligomers with reactive or non-reactive polymers. These systems are generally composed of 100% solid components and therefore do not require a non-reactive solvent. After the composition is applied to the nail surface, exposure to light such as ultraviolet rays, actinic rays, or other wavelengths including visible light initiates a chemical reaction, thereby forming a thermosetting nail coating having a crosslinked structure that is durable and long-lasting. Such thermosetting coatings are very difficult to remove.

Accordingly, artificial nails can exhibit significantly improved adhesion, durability, scratch resistance, and solvent resistance as compared to nail polish.

In particular, when a light-curable nail product (e.g., gel or acrylic) is applied to the surface of a fingernail or toenail, the user places the nail under a nail lamp. The nail lamp emits light to initiate and proceed with the curing process, thereby completing a durable nail coating.

The above information disclosed in this Background section is only for understanding of the background of the inventive concepts, and, therefore, it may contain information that does not constitute prior art.

SUMMARY

Portable nail lamps constructed according to the principles and implementations of the invention includes a lamp unit provided with a plurality of lamps on its lower side, a support unit positioned to face the lamp unit, and at least one support arm connecting the lamp unit and the support unit. Through the support arm, the height and angle of the lamp unit connected to the support unit can be freely adjusted, thereby achieving an optimal nail curing efficiency.

Furthermore, upon completion of the nail curing process, the user can fold the portable nail lamp by fully collapsing the support arm such that the lamp unit and the support unit come into contact with each other, thus allowing the device to be carried conveniently.

Additional features of the inventive concepts will be set forth in the description which follows, and in part will be apparent from the description, or may be learned by practice of the inventive concepts.

According to one aspect of the invention, a portable nail lamp includes: a lamp unit configured as a hollow body and including a plurality of lamps arranged on a lower surface thereof to emit light downward for curing a nail coating; a support unit formed as a plate member and disposed to face the lamp unit; and at least one support arm connecting the lamp unit and the support unit, the support arm having opposite ends hinge-coupled to the lamp unit and the support unit, respectively, and configured to permit adjustment of a height and an angle of the lamp unit relative to the support unit.

The lamp unit may be formed in a hollow circular disk shape, and the support unit may be formed in a circular disk shape corresponding to an outer contour of the lamp unit.

The support unit may include yoke portions provided on both lateral sides of an upper surface of the support unit, each yoke portion having a U-shaped groove, and a lower end of the support arm may be rotatably coupled within the yoke portion by a hinge shaft extending horizontally therethrough.

A hinge coupling groove may be recessed in a lower surface of the lamp unit, and an upper end of the support arm may be inserted into the hinge coupling groove and rotatably coupled by a hinge shaft.

A storage groove may be further formed in the lower surface of the lamp unit so that the support arm and the yoke portion of the support unit may be accommodated within the storage groove when the support arm is folded.

A lower end of the support arm may be hinge-coupled near an edge portion of an upper surface of the support unit so that, when the support arm may be folded, the lamp unit and the support unit may be stacked on each other.

The lower surface of the lamp unit may include a plurality of openings, and the lamps are exposed through the openings to emit light downward.

The lamps may include ultraviolet light-emitting diodes (UV-LEDs).//A power button may be provided on one side of an upper surface of the lamp unit to control on/off operation of the lamps.

A power circuit and a driving circuit for operating the lamps may be embedded inside the lamp unit.

A battery may be embedded inside the lamp unit, and a charging port for charging the battery may be provided on an outer circumferential surface of the lamp unit.

The support arms may include a pair of support arms arranged on opposite lateral sides between the lamp unit and the support unit.

An internal yoke portion may be formed inside the lamp unit to define the hinge coupling groove.

The hinge coupling groove may have a width corresponding to a width of an upper end of the support arm so that the upper end of the support arm is rotatable therein.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1:
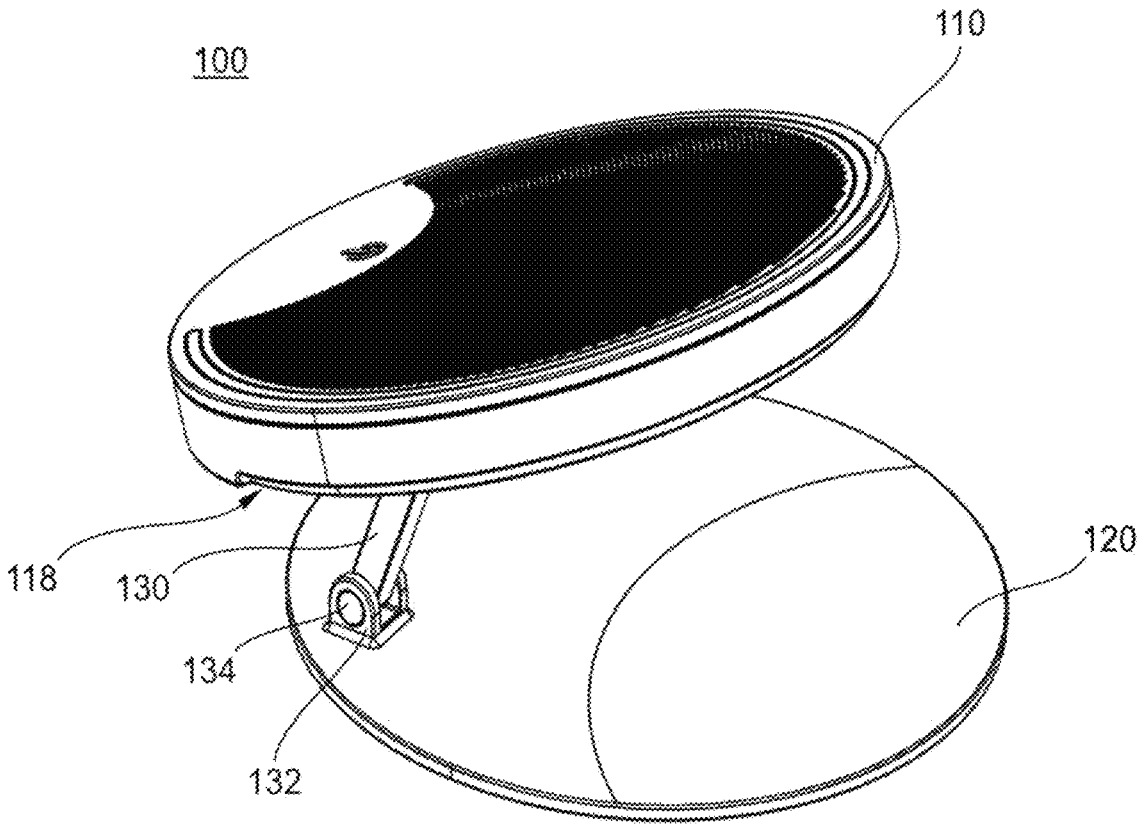
FIG. 1 is a perspective view showing a portable nail lamp in an unfolded state according to the present invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z—axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
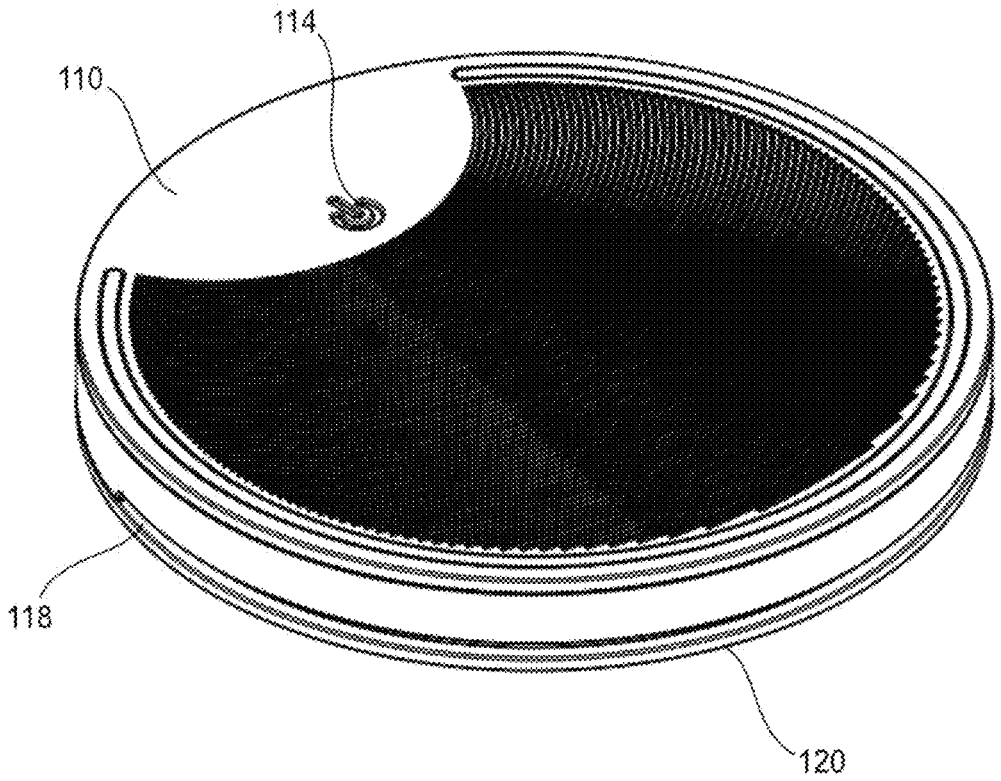
FIG. 2 is a perspective view showing the portable nail lamp in a folded state according to the present invention.
Figure 3A:
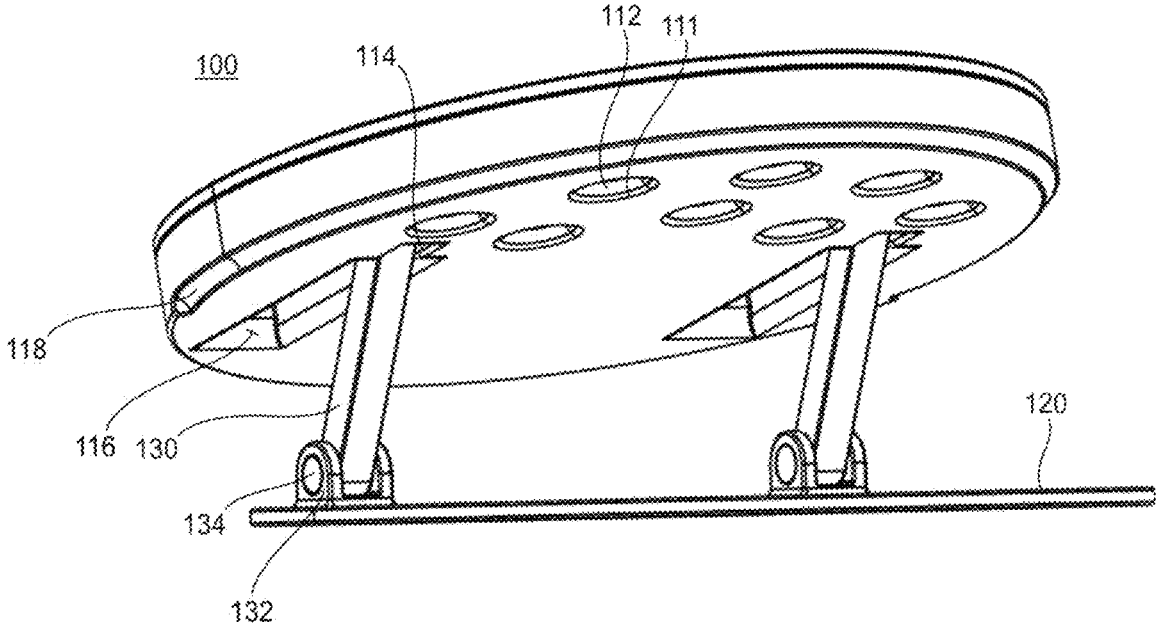
FIG. 3A is a bottom perspective view of the portable nail lamp in the unfolded state as shown in FIG. 1.
Figure 3B:
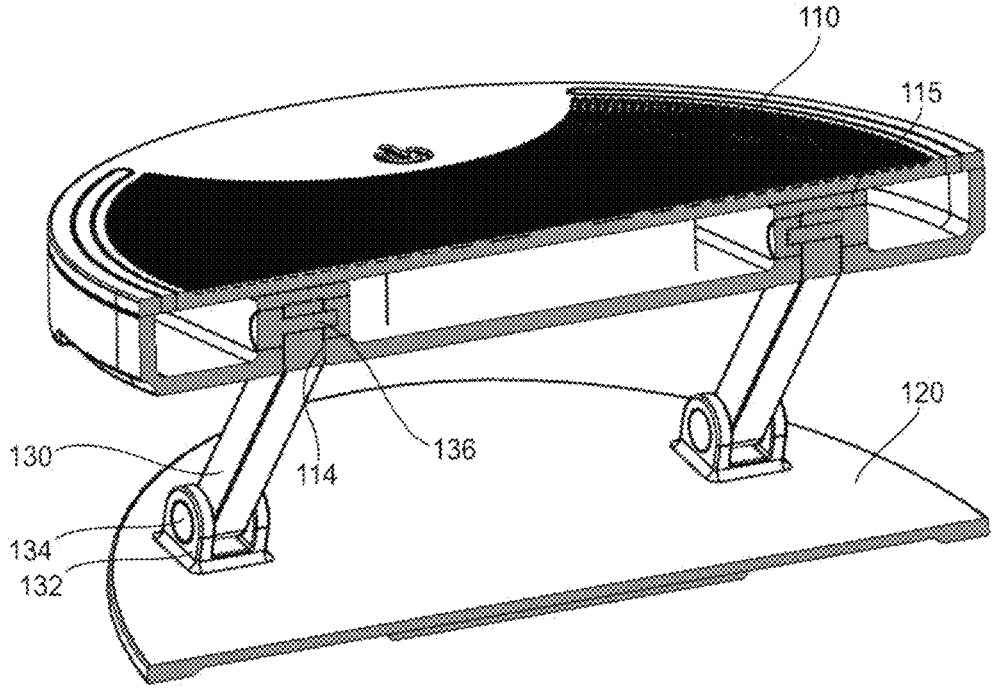
FIG. 3B is a longitudinal cross-sectional view of the portable nail lamp in the unfolded state as shown in FIG. 1.
Figure 4:
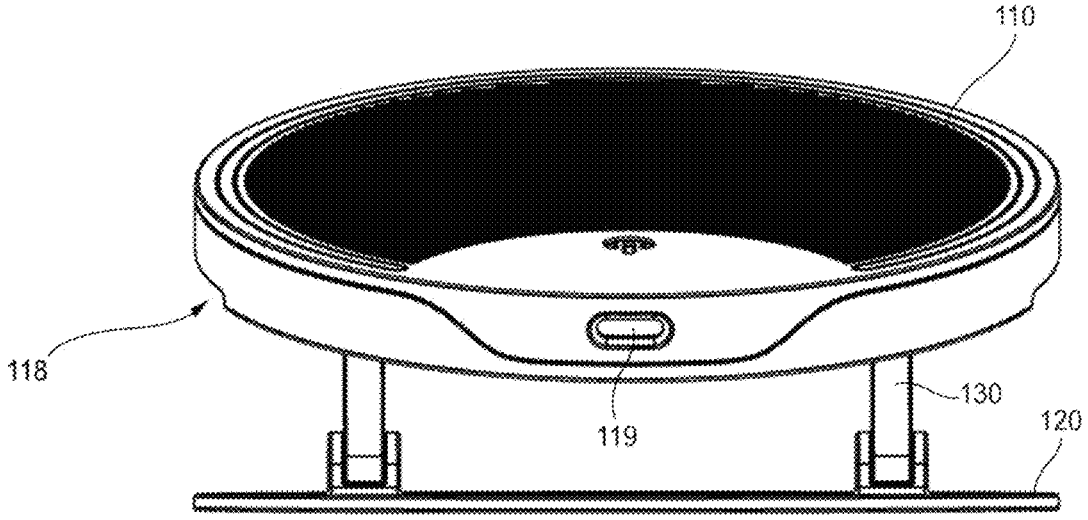
FIG. 4 is a front view of the portable nail lamp in the unfolded state as shown in FIG. 1.
Figure 5:
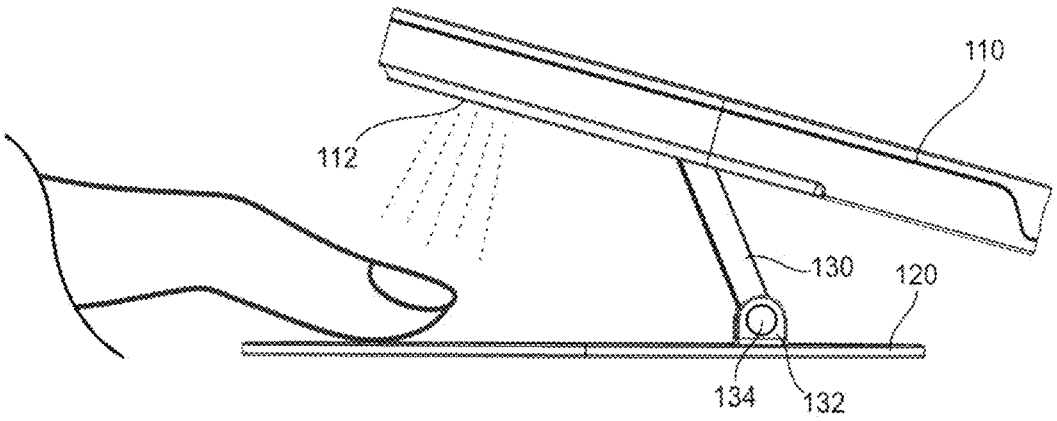
FIG. 5 is a view illustrating an example of use of the portable nail lamp according to the present invention.
Figure 6:
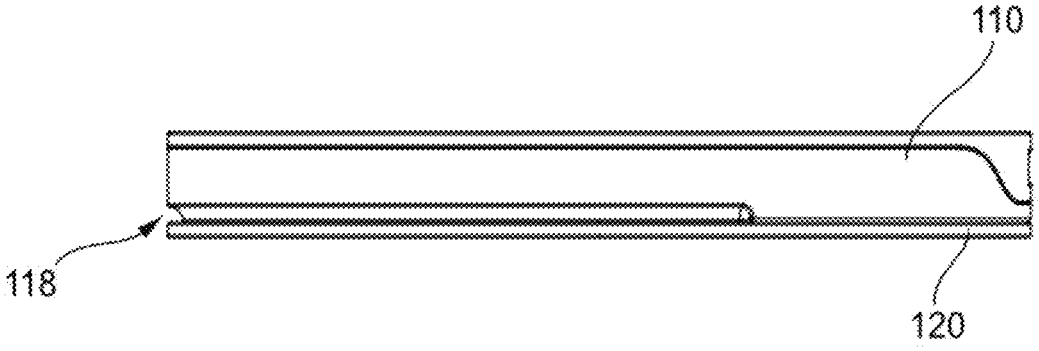
FIG. 6 is a side view of the portable nail lamp in the folded state as shown in FIG. 2.

FIG. 1 is a perspective view showing a portable nail lamp 100 in an unfolded state according to the present invention, FIG. 2 is a perspective view showing the portable nail lamp in a folded state, FIG. 3A is a bottom perspective view of the portable nail lamp in the unfolded state as shown in FIG. 1, FIG. 3B is a longitudinal sectional view of the portable nail lamp in the unfolded state as shown in FIG. 1, FIG. 4 is a front view of the portable nail lamp in the unfolded state as shown in FIG. 1, FIG. 5 is a view illustrating an example of use of the portable nail lamp according to the present invention, and FIG. 6 is a side view of the portable nail lamp in the folded state as shown in FIG. 2.

Referring to FIGS. 1, 3A, 3B, 4, and 5, the portable nail lamp 100 manufactured according to the principles and implementations of the invention may include a lamp unit 110 having a plurality of lamps 112 on a lower surface, a support unit 120 disposed to face the lamp unit 110, and at least one support arm 130 connecting the lamp unit 110 and the support unit 120. The height and angle of the lamp unit 110 connected to the support unit 120 may be adjusted through the support arm 130.

More specifically, as illustrated in FIG. 5, a user may place his or her finger on the upper surface of the support unit 120 and align it with the lamps 112 positioned on the lower surface of the lamp unit 110. The user may then adjust the height and angle of the lamp unit 110 according to individual needs so that light is irradiated in an optimal manner, thereby achieving efficient nail curing.

As shown in FIGS. 2 and 6, when the nail curing process is completed, the user may completely fold the support arm 130 such that the lamp unit 110 and the support unit 120 come into contact with each other, thereby allowing the portable nail lamp 100 to be conveniently carried.

The lamp unit 110 is a component that generates light for curing a coating applied to the user's nail. The lamp unit 110 is configured as a generally flat hollow housing having a predetermined thickness, and more specifically, as a hollow circular disk. A plurality of openings 111 are formed in the lower surface, and the lamps 112 are exposed through the openings 111 to irradiate light downward for curing the coating. Although not limited thereto, the lamps 112 are preferably UV-LEDs. Although not shown, a power circuit and a driving circuit for operating the lamps 112 are embedded inside the hollow interior of the lamp unit 110. In addition, a power button 114 for controlling ON/OFF of the lamps 112 may be provided on one side of the upper surface of the lamp unit 110 (see FIGS. 1, 3A, 3B, and 4).

The support unit 120 is disposed below the lamp unit 110 and serves to support the entire nail lamp of the present invention from below by being placed on a surface. The support unit 120 is preferably formed as a thin plate, and more preferably as a disk-shaped member corresponding to the contour of the lamp unit 110 (see FIGS. 1 and 4).

The lamp unit 110 and the support unit 120 are connected by the support arms 130. Preferably, two support arms 130 are provided, one on each lateral side between the lamp unit 110 and the support unit 120. The support arms 130 are hinge-coupled at upper and lower ends to the lower surface of the lamp unit 110 and the upper surface of the support unit 120, respectively, so as to allow adjustment of the distance and angle between the lamp unit 110 and the support unit 120 (see FIGS. 1, 3A, 3B, 4, and 5).

To this end, as shown in FIG. 4, yoke portions 132 having U-shaped grooves formed therein are protruded from both lateral sides of the upper surface of the support unit 120. The lower ends of the support arms 130 are inserted into the U-shaped grooves of the yoke portions 132, and hinge shafts 134 horizontally pass through the yoke portions 132 so that the support arms 130 are rotatably coupled therein.

As shown in FIGS. 3A and 3B, a hinge coupling groove 114 recessed into the lower surface of the lamp unit 110 is formed so that the upper ends of the support arms 130 can be inserted and rotatably coupled by hinge shafts 136. For the hinge coupling groove 114, a yoke portion 115 protruding upward inside the hollow disk of the lamp unit 110 is formed. The upper ends of the support arms 130 are inserted into the hinge coupling groove 114 of the yoke portion 115 and rotatably coupled by the hinge shafts 136 passing through the sidewalls of the yoke portion 115 and the upper ends of the support arms 130.

Further, as shown in FIG. 3A, a storage groove 116 recessed into the lower surface of the lamp unit 110 is additionally formed on one side of the hinge coupling groove 114. The storage groove 116 communicates with the hinge coupling groove 114 and is configured to accommodate the support arms 130 and the yoke portions 132 of the support unit 120 therein when the support arms 130 are folded.

Accordingly, as shown in FIGS. 1, 3A, 3B, 4, and 5, when the support arms 130 are unfolded, the support unit 120 and the lamp unit 110 are spaced apart from each other, and the user may freely adjust the height and angle of the lamp unit 110 by changing the position of the support arms 130.

When the support arms 130 are completely folded horizontally, as shown in FIGS. 2 and 6, the lamp unit 110 and the support unit 120 are stacked on each other so that the entire device is transformed into a flat disk shape, thereby facilitating portability and storage. For this purpose, it is preferable that the lower ends of the support arms 130 are hinge-coupled to positions near the edge portion of the upper surface of the support unit 120.

As shown in FIGS. 2 and 6, when the lamp unit 110 and the support unit 120 are stacked vertically in the folded state for storage or carrying and are to be used again, the user may lift the lamp unit 110 upward to unfold the support arms 130 so that the lamp unit 110 is spaced apart from the support unit 120. To facilitate lifting of the lamp unit 110 by the user, it is preferable that a recessed step portion 118 is formed on one side of the lower edge of the lamp unit 110 facing the upper edge portion of the support unit 120. The user may place a fingertip or nail into the step portion 118 to grip and easily lift the lamp unit 110 away from the support unit 120.

Finally, for operation of the nail lamp according to the present invention, a battery (not shown) may be embedded inside the lamp unit 110, and a charging port 119 may be provided on an outer circumferential surface of the lamp unit 110 for charging the battery.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A portable nail lamp comprising:

a lamp unit configured as a hollow body and including a plurality of lamps arranged on a lower surface thereof to emit light downward for curing a nail coating;

a support unit formed as a plate member and disposed to face the lamp unit; and at least one support arm connecting the lamp unit and the support unit, the at least one support arm having opposite ends hinge-coupled to the lamp unit and the support unit, respectively, and configured to permit adjustment of a height and an angle of the lamp unit relative to the support unit, wherein the at least one support arm comprises a pair of support arms arranged on opposite lateral sides between the lamp unit and the support unit.

2. The portable nail lamp of claim 1, wherein the lamp unit is formed in a hollow circular disk shape, and the support unit is formed in a circular disk shape corresponding to an outer contour of the lamp unit.

3. The portable nail lamp of claim 1, wherein the at least one support unit includes yoke portions provided on both lateral sides of an upper surface of the support unit, each yoke portion having a U-shaped groove, and wherein a lower end of the at least one support arm is rotatably coupled within the yoke portions by a hinge shaft extending horizontally therethrough.

4. The portable nail lamp of claim 3, wherein a storage groove is further formed in the lower surface of the lamp unit so that the at least one support arm and the yoke portions are accommodated within the storage groove when the at least one support arm is folded.

5. The portable nail lamp of claim 1, wherein a hinge coupling groove is recessed in a lower surface of the lamp unit, and an upper end of the at least one support arm is inserted into the hinge coupling groove and rotatably coupled by a hinge shaft.

6. The portable nail lamp of claim 5, wherein an internal yoke portion is formed inside the lamp unit to define the hinge coupling groove.

7. The portable nail lamp of claim 5, wherein the hinge coupling groove has a width corresponding to a width of an upper end of the at least one support arm so that the upper end of the at least one support arm is rotatable therein.

8. The portable nail lamp of claim 1, wherein a lower end of the at least one support arm is hinge-coupled near an edge portion of an upper surface of the support unit so that, when the at least one support arm is folded, the lamp unit and the support unit are stacked on each other.

9. The portable nail lamp of claim 1, wherein the lower surface of the lamp unit includes a plurality of openings, and the lamps are exposed through the openings to emit light downward.

10. The portable nail lamp of claim 1, wherein the lamps comprise ultraviolet light-emitting diodes (UV-LEDs).

11. The portable nail lamp of claim 1, wherein a power button is provided on one side of an upper surface of the lamp unit to control on/off operation of the lamps.

12. The portable nail lamp of claim 1, wherein a power circuit and a driving circuit for operating the lamps are embedded inside the lamp unit.

13. The portable nail lamp of claim 1, wherein a battery is embedded inside the lamp unit, and a charging port for charging the battery is provided on an outer circumferential surface of the lamp unit.

* * * * *